United States Patent [19]

Vogel

[11] 3,982,382

[45] Sept. 28, 1976

[54] ARTICLE BUCKET WITH CIRCULAR CLAMP

[75] Inventor: Walter H. Vogel, Hoffman Estates, Ill.

[73] Assignee: Crompton & Knowles Corporation, Worcester, Mass.

[22] Filed: May 22, 1975

[21] Appl. No.: 579,767

[52] U.S. Cl. ..... 53/252; 53/156; 269/238

[51] Int. Cl.[2] ..... B65B 5/04

[58] Field of Search ..... 53/50, 252, 251, 156; 269/238

[56] References Cited

UNITED STATES PATENTS

| | | | |
|---|---|---|---|
| 1,935,269 | 11/1933 | Jones | 53/252 |
| 2,263,501 | 11/1941 | Jones | 53/156 |
| 2,973,197 | 2/1961 | Algatt et al. | 269/238 X |
| 3,523,400 | 8/1970 | Daily | 53/50 X |

*Primary Examiner*—Leon Gilden

[57] ABSTRACT

A packaging machine which includes article buckets and leaflet clamps mounted on the buckets, each clamp having a spring loaded jaw which, in the open position, allows a leaflet to be inserted between the jaw and bottom plate of its respective article bucket, and, in the closed position, is effective to clamp a leaflet between the jaw and bottom plate to deflect a portion of it into the exit end opening of the bucket. Means are provided for opening the clamp jaw, inserting a leaflet between the open clamp jaw and bottom plate, closing the clamp jaw to clamp the leaflet and opening the clamp jaw to allow the leaflet to be carried into a carton by the article as it is transferred from the article bucket to the carton.

6 Claims, 8 Drawing Figures

10
12
14
15
16
17
18
20
22
23
28
36
43
45
46
47
49
51
52
53
54
66
68
70
72
74
76
78
80
82
84
86
2
3

18
20
23
24
26
28
30
32
34
36
38
40
42
43
44
47
66
68
70
74
76
78
80
82
4
5

45
46
47
48
51
52
54

ARTICLE BUCKET WITH CIRCULAR CLAMP

BACKGROUND OF THE INVENTION

This invention relates generally to packaging machines and particularly to packaging machines in which leaflets containing advertising or instructions are inserted into a carton or package with the article.

Generally, leaflets are fed as a continuous strip from a roll, cut into individual leaflets, and conveyed to the packaging apparatus. In some machines, the leaflets are inserted into the open ends of the cartons prior to the insertion of the articles into the cartons. In other machines, the leaflets are conveyed with the article buckets and are folded over the product immediately prior to its being thrust into the carton so that the article itself conveys the leaflet into the carton. The invention is directed to the latter type of machine.

SUMMARY OF THE INVENTION

It is a principle object of the invention to provide means for inserting a leaflet into a carton with the product which are greatly simplified and yet are effective for controlling the leaflet with a high degree of accuracy as it is inserted into the carton.

The object of the invention is accomplished by providing a spring loaded leaflet jaw on each article bucket and means for opening and closing the jaw in timed relation with other operating components of the packaging machine. The positioning of the jaw and the timing is such that a leaflet is partially inserted between the open jaw and the lower surface of the article bucket, folded across the front of the article by the jaw as it is closed and then inserted into the carton with the article as the jaw reopens.

DETAILED DESCRIPTION OF THE INVENTION

Figure 1:
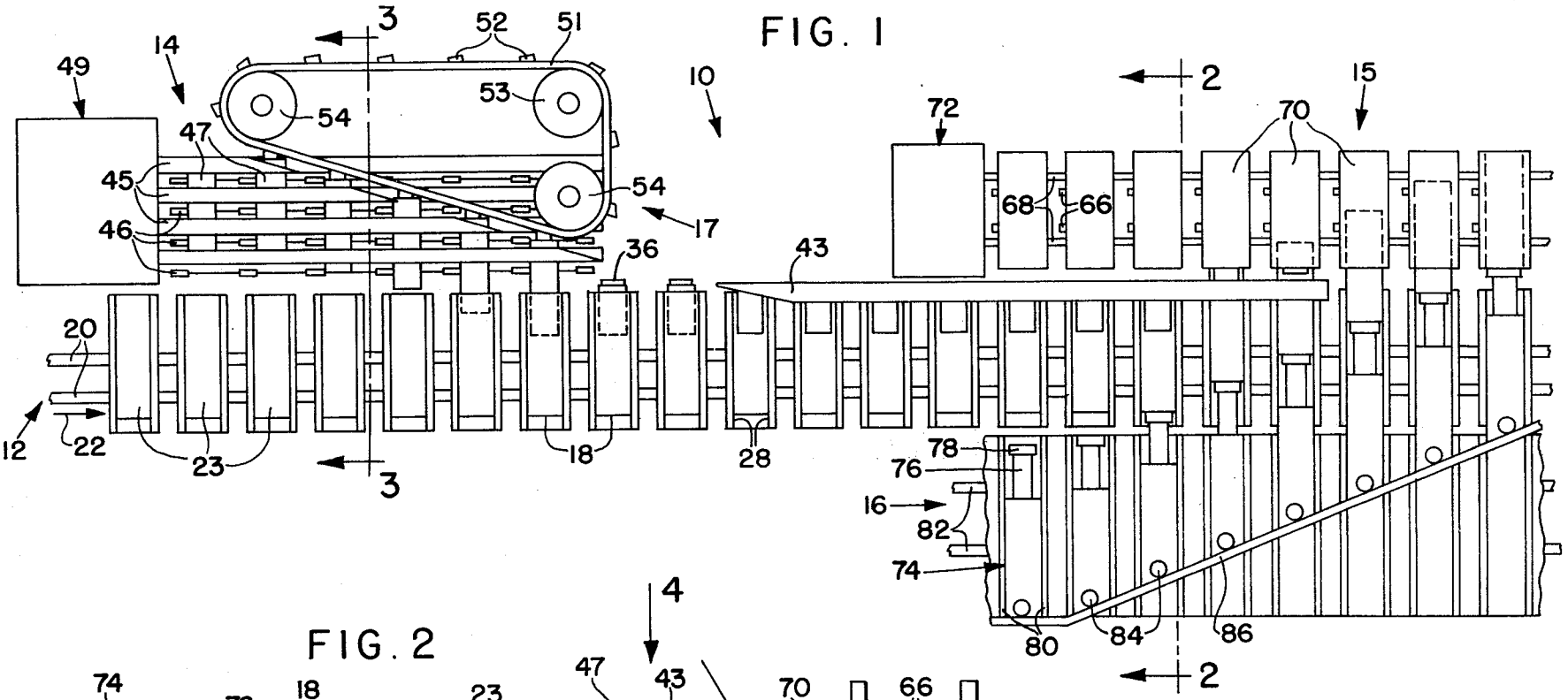
FIG. 1 is a diagrammatic plan view of a packaging machine to which the present invention is applied.

Referring to FIG. 1, the packaging machine to which the invention is applied is indicated generally by the reference numeral 10 and includes an article bucket conveyor 12, a leaflet conveyor 14, a leaflet transfer conveyor 17, a carton conveyor 15, and an article transfer conveyor 16. Conveyor 12 comprises a plurality of article buckets 18 mounted on a pair of endless chains 20, the top runs of which are driven in the direction of arrow 22 by drive means, not shown. The articles to be packaged are indicated at 23 and are deposited within the buckets at a point upstream by means well-known in the art, but which are not part of this invention.

Figure 2:
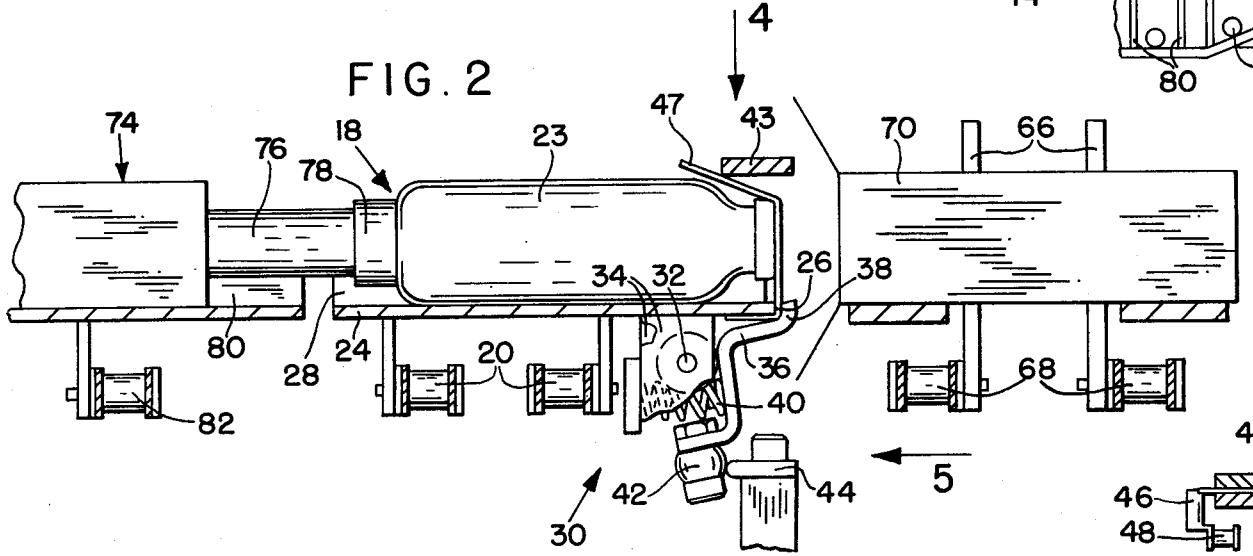
FIG. 2 is an enlarged vertical section taken on line 2—2 of FIG. 1, looking in the direction of the arrows and showing details of an article bucket and clamp of the present invention just prior to insertion of an article and leaflet into a carton.
Figure 3:
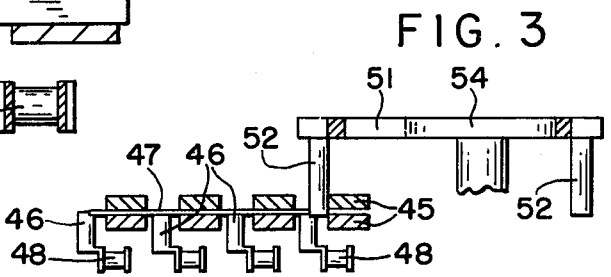
FIG. 3 is a vertical section taken on line 3—3 of FIG. 1, looking in the direction of the arrows and showing details of mechanism for transferring leaflets to the article buckets.
Figure 4:
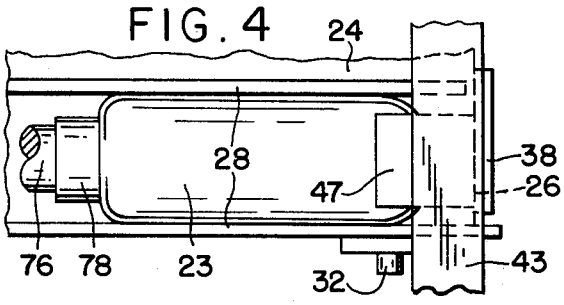
FIG. 4 is a fragmentary plan view of the article bucket shown in FIG. 2.
Figure 5:
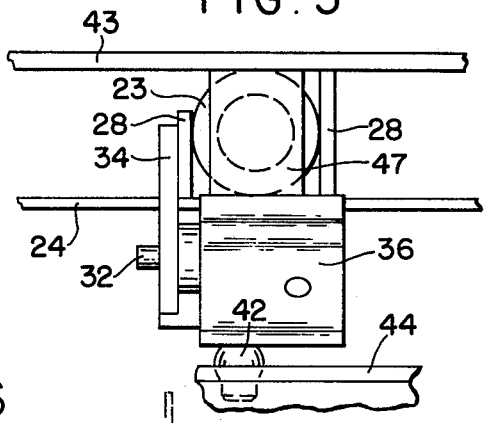
FIG. 5 is a fragmentary elevation of the front portion of the clamp and article bucket, looking in the direction of arrow 5 in FIG. 2.

Referring to FIGS. 2–4, one of the buckets 18 is shown in greater detail and includes a bottom plate 24 which has a front edge 26 and sides 28. A clamp generally indicated at 30 is pivotably mounted at 32 between a pair of brackets 34 which extend downwardly from sides 28. Clamp 30 comprises a jaw 36 which includes a lip 38 and a compression spring 40 which normally maintains jaw 36 in the closed position with lip 38 against the front edge 26 of plate 24. A follower 42 is fixed to the lower end of clamp 36 for engagement with an elongated cam 44. Cam 44 is positioned to open the jaw 36 at the proper time during a packaging sequence which will be described in greater detail.

Referring particularly to FIGS. 1 and 2, leaflet conveyor 14 comprises a plurality of spaced vertical bars 46 mounted on endless chains 48, the top runs of which travel parallel to, and in the same direction as, chains 20. Bars 46 are arranged in transverse groups on chain 48 and travel between horizontally spaced vertical pairs of stationary guide plates 45. Each pair of guide plates comprises an upper plate and a lower plate which are vertically spaced. Bars 46 extend above the vertical spaces between each pair of guide plates.

Leaflets 47 are inserted in the vertical spaces between the upper and lower guide plates 45 from a leaflet folder generally indicated by the reference numeral 49.

The means for supplying the leaflets to the leaflet folder and the details of the leaflet folder are not shown since they are well-known in the art. The circulars may have only one thickness, in which case the leaflet folder would not be needed. The leaflets 47 are deposited on conveyor 14 from leaflet folder 49 in timed relation with the conveyor so that a leaflet is deposited in front of each transverse group of bars 46 as they rise from the lower runs to the upper runs of conveyor chains 48 and carried thereby in the direction of arrow 22. Conveyors 12 and 14 are synchronized so that leaflets 47 travel in alignment with buckets 18, and bars 46 are so spaced that there will be one leaflet 47 aligned with each bucket 18.

Leaflet transfer conveyor 17 is located above conveyor 14 and comprises an endless chain 51 which carries a plurality of spaced push rods 52. Chain 51 is driven counter-clockwise, as viewed in FIG. 1, by a drive sprocket 53 in timed relation with conveyors 12 and 14 and trained around idler sprockets 54 which are diagonally disposed with respect to the path of travel of conveyor 14. Push rods 52 extend downwardly below the spaces between the upper and lower guide bars and are so positioned with respect to vertical bars 46 that they engage the ends of the leaflets 47 which are furthest from buckets 18 shortly after the leaflets are engaged by the bars 46. The leaflets 47 are first engaged by push rods 52 near the upper left-hand idler sprocket 54, as viewed in FIG. 1, and are gradually pushed toward the article buckets by rods 52. The speed of conveyor 51 is such that the rods 52 travel at the same linear speed as bars 46 in the direction of travel of the bars 46 so that rods 52 will always be in engagement with respective leaflets 47 and will not interfere with bars 46. The total speed of conveyor 51 is greater than conveyor 14 and the difference is represented by the displacement of the rods 52 in the transverse direction to the direction of travel of the upper run of conveyor 14. Guide bars 45 extend only to the diagonal path of travel of rods 52 so as not to interfere with the movement of the rods.

Figure 6:
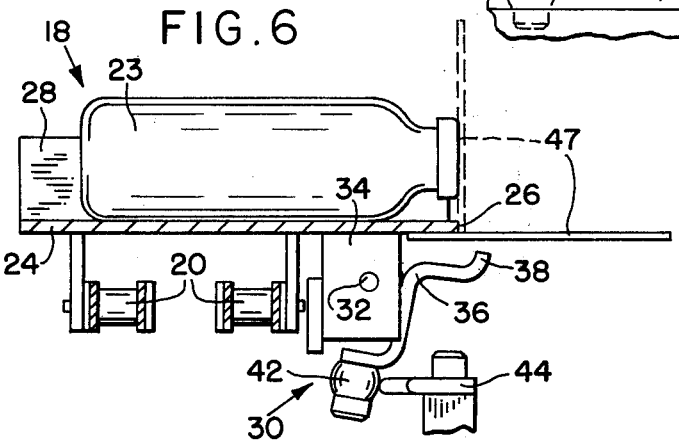
FIGS. 6–8 are operational views showing the steps of feeding a leaflet to the article bucket and transferring the leaflet with the article from the bucket into a carton.
Figure 7:
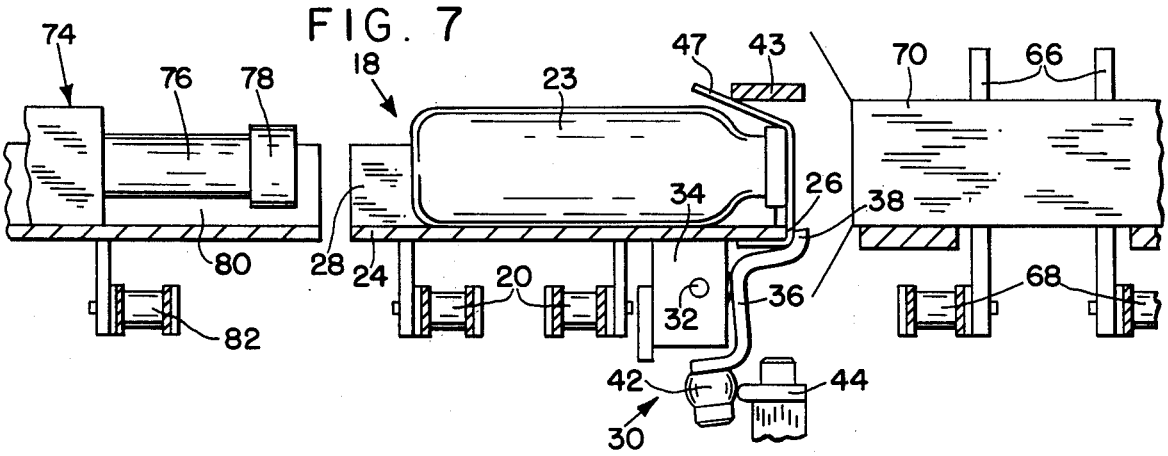

As a leaflet 47 nears a bucket 18, jaw 36 of its clamp 30 will be opened by cam 44 so that the leaflet 47 will be pushed between the undersurface of bottom plate 24 and the opend jaw 36, as shown in full lines in FIG. 6. Shortly thereafter, cam 44 will allow jaw 36 to close and pinch the leaflet between lip 38 and the edge 26 of bottom plate 24. This causes the leaflet 47 to bend at edge 26 and deflect a portion of the leaflet to a vertical position, as shown in dotted lines in FIG. 6. A stationary cam 43 is positioned above conveyor 12 in vertical alignment with clamp 36 and is effective to bend the upper part of the leaflet 47 back towards the article, as shown in FIG. 7. The clamped leaflets 47 together with articles 23 are conveyed between carton conveyor 15 and article transfer conveyor 16. Carton conveyor 15 comprises pusher rods 66 attached to endless chains 68 which are synchronized with chains 20 of conveyor 12 so that their respective upper rows, as shown in FIG. 1, are parallel and travel in the same direction at the same speed. Cartons 70, which are open at one end, are deposited on conveyor 15 from a carton feed 72. Conveyor 15 is synchronized with carton feed 72 so that a carton 70 is deposited on conveyor 15 for each bucket 18 that passes by the carton feed 72. The pusher rods 66 are so spaced that each article within a bucket 18 is aligned with the open end of a carton, as shown in FIG. 1.

Article transfer conveyor 16 is located on the opposite side of article conveyor 12 with respect to carton conveyor 15. Article transfer conveyor 16 comprises a plurality of pusher members 74 each of which comprises an elongated shank portion 76 and a foot part 78. Each pusher member 74 is slidably mounted in a U-shaped support member 80 for movement in a direction transverse to the direction of movement of conveyor 12. The support members 80 are mounted on chains 82 which are synchronized with claims 20 of conveyor 12. Pusher members 74 are spaced so that they are aligned with the buckets 18 and move in synchronism with the buckets. Each pusher member carries a cam roller 84 which extends upwardly from the shank portion 76. A stationary cam 86 is mounted diagonally over the pusher members and is fixed to the frame of the machine. As a pusher member advances in the direction of arrow 22, its cam roller 84 engages the stationary cam 86 which causes the pusher member 74 to slide transversely in its U-shaped support member 80. The transverse motion of pusher member 74 causes its foot part 78 to engage the article 23 in the bucket 18 with which it is aligned. Foot part 78 continues to push the article 23 along bucket 18 towards the aligned carton 70. Each pusher member 74 will move from its U-shaped support into the aligned bucket 18 as the article 23 therein is pushed into the aligned carton 70, as shown in the extreme right-hand portion of FIG. 1. A stationary return cam, not shown, is positioned at a point downstream of cam 86 to engage the cam rollers 84 after the articles have been completely transferred into their respective cartons. The stationary return cam is effective to shift the pusher members 74 back to their normal positions in U-shaped brackets 80.

Figure 8:
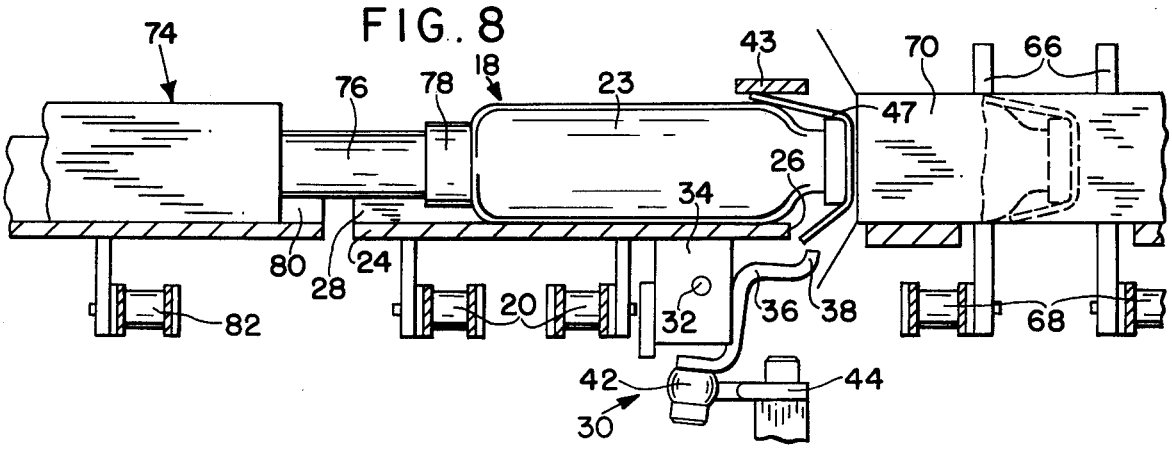

As pusher member 74 begins to push article 23 out of its bucket 18, cam 44 acts on follower 42 to open jaw 36 and release the lower portion of leaflet 47, as shown in FIG. 8. As the article 23 continues to be pushed into carton 70, leaflet 47 will be pushed into the carton by the article, as shown in dotted lines in FIG. 8. Additional machinery, not shown, is provided downstream of conveyor 15 for closing the open end of the cartons 70 but forms no part of this invention.

I claim:

1. In a packaging machine having a conveyor with a plurality of buckets thereon for carrying articles and means for transferring the articles from the buckets into cartons, the improvement comprising:

a. each article bucket having a bottom plate with a top surface, a bottom surface and a front edge over which the article is transferred into a carton;

b. a clamp mounted on said article buckets and having a clamping jaw which is movable between a closed position and an open position, wherein said clamping jaw is effective, in open position, to allow a leaflet to be partially inserted between the bottom surface of said article bucket and said clamping jaw so that the remaining portion of said leaflet extends horizontally beyound the front edge of said article bucket and effective, in the closed position, to deflect the horizontally extending portion of an inserted leaflet to a substantially vertical position and to clamp said leaflet against said front edge;

c. means for inserting a leaflet between said bottom surface and said open clamping jaw; and d. means for opening and closing said clamp so that said clamp is open to receive a leaflet, closed to deflect and clamp said leaflet, and opened to release said leaflet for transfer of an article from said bucket, whereby said article will engage the vertically extending portion of said leaflet as it passes over the front edge of said bucket and carry it into a carton.

2. In a packaging machine as set forth in claim 1 wherein said clamping jaw is pivotally mounted on said bucket and wherein said opening and closing means comprises:

a. a spring for urging said clamping jaw into the closed position;

b. a cam follower attached to said clamping jaw; and c. a cam for engaging said cam follower against the action of said spring for opening said clamping jaw.

3. In a packaging machine as set forth in claim 1 wherein said clamping jaw comprises a lip portion which extends below said bottom surface when said jaw is in the open position and above said bottom surface and in front of said front edge when said jaw is in the closed position, said lip being effective to clamp a leaflet against the front edge of said bottom plate.

4. In a packaging machine as set forth in claim 1 wherein said clamp comprises:

a. a lip portion forming part of said clamping jaw and which extends below the bottom surface of said bucket when said jaw is in the open position and above said bottom surface and in front of said front edge when said jaw is in the closed position, said lip being effective to clamp a leaflet against the front edge of said bottom plate; and b. resilient means for maintaining said clamp in the closed position, whereby said lip is normally urged toward said front edge.

5. An article bucket for a packaging machine comprising:

a. A bottom plate having a top surface, a bottom surface and a front edge; and b. A clamp mounted on said bucket and having a clamping jaw, which is moveable between a closed position and an open position, said clamping jaw being effective for clamping a leaflet against said bottom surface, said clamping jaw including a lip portion which extends below said bottom surface when said jaw is in the open position and extends in front of said front edge and above said bottom surface when said jaw is in the closed position, whereby a leaflet may be inserted between said bottom surface and said jaw when said jaw is in the open position so that the remaining position of said leaflet extends horizontally beyond said front edge and whereby said leaflet is clamped against said bottom surface and the horizontally extended portion of said leaflet is deflected to a substantially vertical position by said lip portion. When said jaw is in the closed position.

6. The article bucket as set forth in claim 5 comprising resilient means for maintaining said clamp in the closed position.

* * * * *

UNITED STATES PATENT AND TRADEMARK OFFICE

CERTIFICATE OF CORRECTION

PATENT NO. : 3,982,382

DATED : September 28, 1976

INVENTOR(S) : ARTICLE BUCKET WITH CIRCULAR CLAMP

It is certified that error appears in the above–identified patent and that said Letters Patent are hereby corrected as shown below:

In the Claims:

Column 6, line 6; cancel the period and change "When" to --when--.

Signed and Sealed this

*Tenth* Day of *January 1978*

[SEAL]

*Attest:*

RUTH C. MASON
*Attesting Officer*

LUTRELLE F. PARKER
*Acting Commissioner of Patents and Trademark*